United States Patent [19]

Johnson et al.

[11] 4,163,477

[45] Aug. 7, 1979

[54] METHOD AND APPARATUS FOR CLOSING UNDERWATER WELLS

[75] Inventors: John L. Johnson; Billy W. Vanzant, both of San Antonio, Tex.

[73] Assignee: Sub Sea Research & Development Corp., San Antonio, Tex.

[21] Appl. No.: 882,865

[22] Filed: Mar. 2, 1978

[51] Int. Cl.[2] ..... E21B 7/12

[52] U.S. Cl. ..... 166/362; 251/1 A; 137/263; 169/69

[58] Field of Search ..... 166/285, 356, 363, 364, 166/368, 362; 175/7, 8, 9; 137/236; 169/69; 251/1 A

[56] References Cited

U.S. PATENT DOCUMENTS

| | | | |
|---|---|---|---|
| 2,000,381 | 5/1935 | Duffy | 169/69 X |
| 2,889,885 | 6/1959 | Hildebrandt | 166/364 X |
| 3,199,595 | 8/1965 | Lafitte et al. | 166/364 |
| 3,211,223 | 10/1965 | Hoch | 166/364 X |
| 3,277,964 | 10/1966 | Houpeurt et al. | 166/285 |
| 3,366,173 | 1/1968 | McIntosh | 166/356 |
| 3,400,730 | 9/1968 | Anderson | 137/236 |
| 3,405,387 | 10/1968 | Koomey et al. | 166/368 X |
| 3,621,911 | 11/1971 | Baker et al. | 166/363 X |
| 3,720,260 | 3/1973 | Duck et al. | 166/364 X |
| 3,740,017 | 6/1973 | Pogonowski | 166/363 X |
| 3,782,458 | 1/1974 | Slack | 169/69 |

*Primary Examiner*—Ernest R. Purser
*Assistant Examiner*—Richard E. Favreau
*Attorney, Agent, or Firm*—Gunn & Lee

[57] ABSTRACT

A method and apparatus is shown and described for remotely closing a well(s) without the possibility of accidental closure. The method and apparatus will have a significant application to underwater wells. A point of activation of a gas generator is remotely located away from the well to avoid debris that may fall at or near the well. A diver or technician brings the means for activating the gas generator to the activation point of the gas generator. Upon activation, pressure generated by the gas generator is transferred by appropriate conduit means to well closure equipment which may include a crimping device, a "U" type blowout preventer, blind rams or any combination thereof. The faces of rams used to pinch concentrical strings of pipe may be shaped to seal the outer strings of pipe as well as inner strings.

10 Claims, 9 Drawing Figures

METHOD AND APPARATUS FOR CLOSING UNDERWATER WELLS

BACKGROUND OF THE INVENTION

The present invention relates primarily to the closure of underwater wells and, more particularly, to a method and apparatus for terminating in case of fire, or uncontrolled blowout during drilling or production, the flow of fluids from oil and gas wells. The means for terminating is both totally reliable and failsafe.

BRIEF DESCRIPTION OF THE PRIOR ART

To control the flow from a burning or damaged well, it is necessary to close the well bore at a location where the casing and tubing are still undamaged and acceptable. One prior art technique is to drill a slant well to intersect the bore of an out-of-control well and use a heavy mud to stop hydrocarbon flow. Another prior art method is the use of explosives to blow out the fire and subsequently seal off the well at the surface or wellhead. These procedures are costly and time consuming. Moreover, when operating from a drilling platform for underwater wells, sending a diver to the point where the well intersects the ocean floor (wellhead) is dangerous since debris from above may fall on the diver. Further, fallen debris may impede adequate access to the wellhead by the divers. Other equipment needed to obtain access to the wellhead may be so bulky that divers cannot adequately handle the equipment.

A method of extinguishing well fires is shown in U.S. Pat. No. 3,647,000 where divers pierce the casing at the wellhead, restrict the effluence flow by crimping the casing walls, introduce materials which form a plug beneath the restriction and stop the effluence flow with a heavy mud.

The apparatus described in U.S. Pat. No. 2,000,381 includes a subterranean cage in which flow control devices are located and controlled via a tunnel extending to the surface of the water. U.S. Pat. No. 1,949,672 also utilizes a tunnel to carry equipment therethrough to the wellhead to pinch the casing shut.

The apparatus disclosed in U.S. Pat. No. 3,590,920 provides for housing containing flow control devices located at the wellhead. The flow control devices are operated by radio signals, which are very prone to false triggering. Another subterranean method of closing the well is disclosed in U.S. Pat. No. 3,277,964 wherein rams are attached to pinch the casing. Thereafter, the discharge is bled and plugging material is injected into the well. The well must be intersected at at least two points in the casing.

A blowout preventer shown in U.S. Pat. No. 3,926,256 discloses a method of restricting well effluence via injection of pins into the annulus and catching sealing material therein. The apparatus claimed is supposed to be remotely controlled from the surface. U.S. Pat. No. 3,631,928 shows an apparatus for drilling into the well casing and closing the well by pumping mud or cement into the casing.

U.S. Pat. No. 3,405,387 and U.S. Pat. No. 3,590,920 use sound waves and radio waves, respectively, to activate underwater well control devices. Such devices may be easily triggered by false or inadvertent signals.

The apparatus disclosed in U.S. Pat. No. 3,512,554 provides a system for purging underwater hydraulic control flowlines to an underwater apparatus. The activation point for the system, while remote from the apparatus itself, is clearly above water on a platform.

U.S. Pat. No. 1,217,837 shows a method of sealing a pipe by pinching the pipe. Such a method is effective only upon a single string of pipe. If one or more strings are located within an outer string, upon pinching the outer pipe with sufficient force, the inner pipe will seal. However, on either side of the inner pipe a portion of the annulus between the inner and outer pipe will remain unsealed.

Current methods of remote control are unsatisfactory because of a high possibility of accidental activation, or a high possibility of failure when activation is desired. A remote diver activated method would solve these difficulties and has not previously been proposed. More particularly, the additional failsafe method of depriving the closing apparatus of an energy source until such source is brought (when needed) by a diver to the remote location is unique. While many means of closing pipe by pinching are currently patented and marketed, none satisfactorily deal with the problem of a pipe concentrically located within other pipe.

SUMMARY OF THE INVENTION

It is an object of the present invention to provide a method of closing underwater wells which may be employed in the event of an accident at the surface, such as a fire. An apparatus to carry out the method is installed at the wellhead or adjacent thereto. The apparatus provides a means of remote activation by personnel who may be prevented from reaching the wellhead due to fire and falling debris. The method can also be applied to runaway wells on land, but a technician with the appropriate gas generator activates the system instead of a diver.

Reliability is assured by the simplicity of the apparatus used to close the well. Protection against an accidental shut-off is also assured both by keeping the energy source for the closing apparatus at a distant location and by requiring diver activation at a remote location.

Initiation of the system would typically begin by a diver taking a source of energy to a remote location. The source of energy is used to activate a gas generator. Pressure created by the gas generator provides the motive force for closing the well. The actual closing of the well (depending upon whether the well is a old well or new well) may be by crimping the tubing shut or by closing appropriate valves.

If a gas generator is used, upon ignition, it produces a volume of gas due to the rapid oxidation of its chemical contents. The gas generated is contained within a pressure containment chamber to create a high pressure. The high pressure is hydraulically communicated to the well closing apparatus by appropriate conduit means. This pressure typically activates a piston which may operate a ram to pinch or cut the tubing shut or close a valve.

In new wells, the flow may be stopped by blowout preventers operated by the gas generator. A Christmas tree (if used) could allow for reentry to the well. On old wells, a device is attached to the outside of the existing string of pipe. A single string of pipe may be closed by pipe squeezers, such as those manufactured and sold by Regent Jack Manufacturing Co., Inc. The presence of one or more strings of pipe within an outer string will reduce the effectiveness of such equipment. Because the inner strings may prevent the outer strings from completely sealing when they are pinched, a particularly designed face of the squeezers (rams) may be necessary. In the event of a single inner string within an outer string, a single concave furrow parallel to the string of pipe and in the center of the face of the rams will close both the inner and outer pipes. The depth, curvature and breadth of the furrow must be determined and should be such that upon pinching of the pipes with the rams, the inner pipe is sealed by the furrow portion of the face, and the remaining overlapping portion of the outer pipe is sealed by remaining flat portions of the ram face. As a precaution against rupture of the outer casing, casing slips and seals are positioned above and below the rams so that leakage is contained within the housing.

Alternately, the apparatus may be attached to old wells and utilize blind rams which completely cut through all existing strings of pipe to form a seal. Adequate sealing must be provided both above and below the blind rams to prevent escape of the effluence. These seals around the string of pipe must be located a sufficient distance from the blind rams to be unaffected by bending of the pipe upon closure of the blind rams. Again, leakage is contained within the housing.

In new wells, appropriate valving and tubing may be installed at the time of completion of the well. A blowout preventer or gate valve may be remotely closed by the gas generator to stop flow through the well.

BRIEF DESCRIPTION OF THE DRAWINGS

The drawings diagrammatically illustrate by way of example, mechanisms for carrying out the claimed invention.

DESCRIPTION OF THE PREFERRED EMBODIMENT

Figure 1:
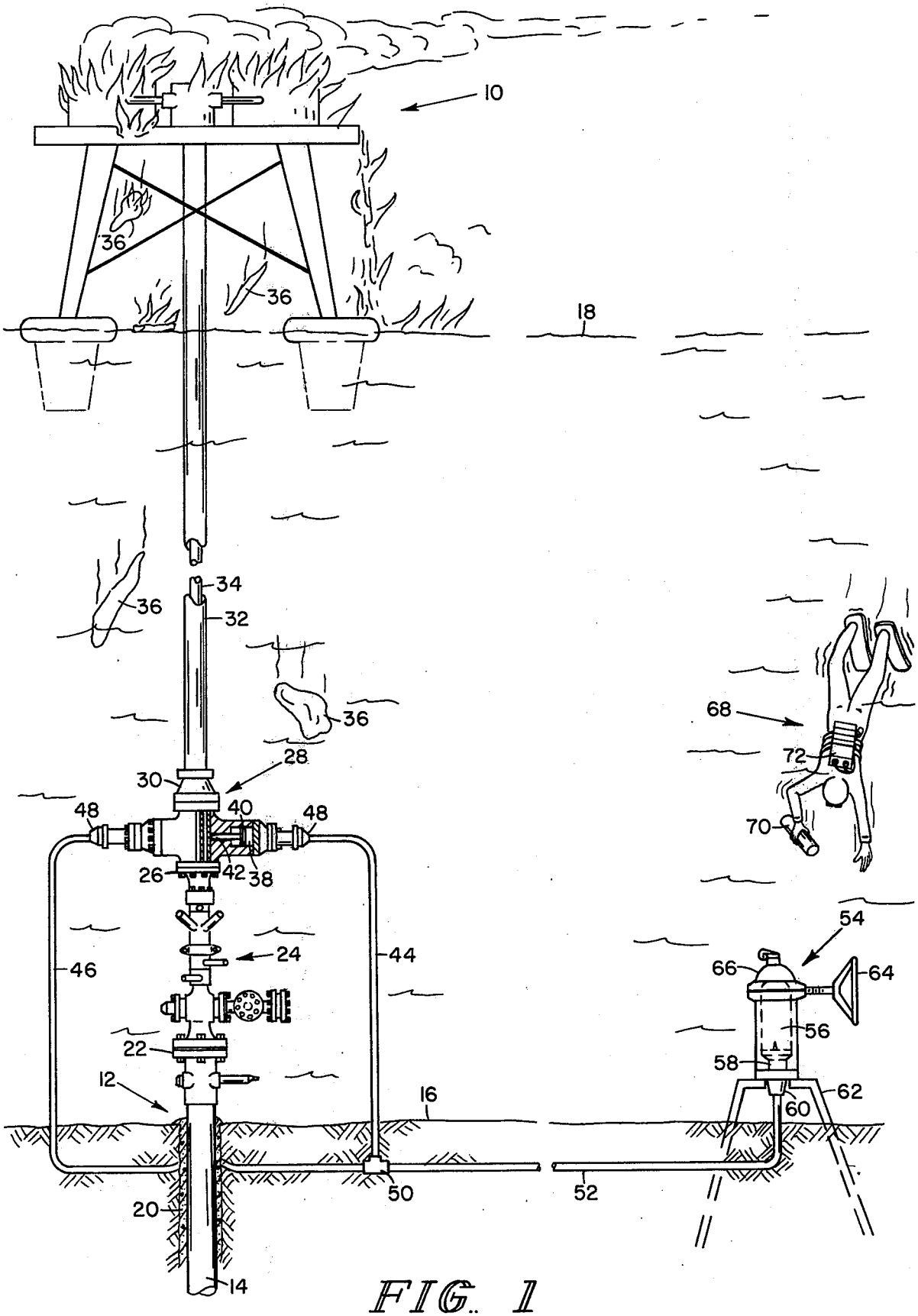
FIG. 1 is an illustrative view of the preferred embodiment showing a method for closing underwater wells.

Referring to FIG. 1 of the drawings, there is shown a pictorial illustration of an offshore drilling platform represented generally by reference numeral 10 wherein the platform has caught fire. Normally an offshore drilling platform will be used from which to drill and operate numerous hydrocarbon producing wells. For the purposes of illustration, only a single well 12 has been shown, but it should be understood that numerous wells connect to the offshore drilling platform 10. It should also be understood that well 12 may be a new well that incorporates apparatus for carrying out the present invention at the time of construction, or may be an old producing well with the apparatus being subsequently incorporated.

Well 12 has a casing 14 extending to formations below the ocean floor 16, which formations will produce hydrocarbons in a fluid form. The offshore drilling platform 10 is located a considerable distance above the coean floor 16, such distance depending upon the depth of the water 18. The casing 14 is held in position in the ocean floor 16 by cement 20. The casing 14 has a connecting flange to which is attached a Christmas tree 24, which Christmas tree is a standard item in the hydrocarbon producing industry.

Connected to the top of the Christmas tree 24 through connecting flange 26 is a pipe squeezer assembly represented generally by reference numeral 28. Connected to the opposite side of pipe squeezer assembly 28 is another connecting flange 30 through which concentric tubes 32 and 34 are connected. One of the concentric tubes 32 and 34 is used for the production of hydrocarbons as delivered to the offshore drilling platform 10 with the other of the concentric tubes 32 or 34 having numerous uses, such as providing secondary lift to aid recovery, just to name one of many uses.

As can be seen in FIG. 1, any hydrocarbons flowing through the concentric tubes 32 or 34 to the platform 10 may add fuel to the fire already in existence. It is imperative to shut off all fluid flow through the concentric tubes 32 and 34. However, access to any controls located on the platform 10 may be impossible due to the fire. Also, falling debris 36 may prevent access to the wellhead at the ocean floor 16 of well 12. In case of fire on off-shore drilling platform 10, it becomes more important to stop flow of hydrocarbons from the well 12 than to worry about being able to continue use of the well 12 once the fire has been put out.

By the use of the pipe squeezer assembly 28, flow through the concentric tubes 32 and 34 may be stopped by activation from a remote point as will be hereinafter described. The pipe squeezer assembly 28 has a cylinder 38 on each side thereof, which cylinder 38 has a piston 40 contained therein. The piston 40 is attached to the drives a ram 42 on each side of the concentric tubes 32 and 34 in a direction perpendicular to the concentric tubes 32 and 34. Upon pressurization of the cylinders 38, pistons 40 are driven toward the concentric tubes 32 and 34, which pistons 40 also drive the rams 42 into the concentric tubes 32 and 34 to pinch them shut. A typical such pipe squeezer as just described is manufactured by Regent Jack Manufacturing Company, Inc. located in Downey, Calif.

The pressurized fluid delivered to cylinders 38 for operating pistons 40 and rams 42 is delivered via conduits 44 ad 46 connected thereto by flanges 48. The conduits 44 and 46 are connected together by tee 50, which tee 50 also connects to one end of supply conduit 52.

The opposite end of supply conduit 52 is connected to a gas generator represented generally by reference numeral 54. The gas generator 54 has a combustion chamber 56 contained therein. Lower opening 58 connects the combustion chamber 56 to the supply conduit 52 via flange 60. The gas generator 54 may be located on any suitable support structure 62. Access to the combustion chamber 56 may be obtained by turning crank 64 to release cap 66.

In case of fire on the offshore drilling platform 10, a diver 68 swims to the gas generator 54 which is located at a point remote from the well 12 and away from the danger of falling debris 36. The diver 68 carries with him a gas generator energy source 70 for insertion in the combustion chamber 56 of the gas generator 54. Also, the diver 68 carries an activation means 72 which can be a battery pack strapped to the back of the diver 68.

Figure 2:
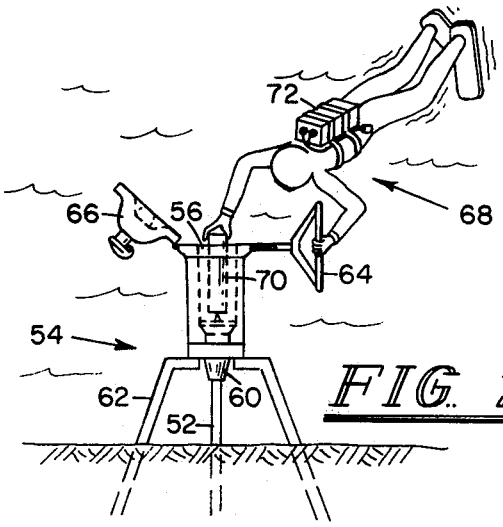
FIG. 2 is a partial sequential view of FIG. 1 showing a diver placing an energy source in a pressure containment chamber of a gas generator.
Figure 3:
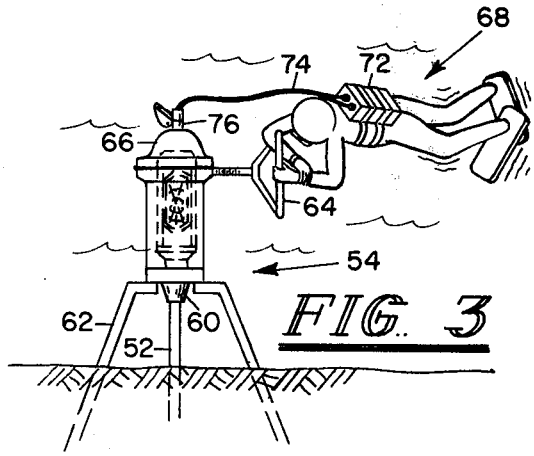
FIG. 3 is a partial sequential view of FIG. 1 showing the diver activating the energy source of the gas generator.

Referring now to FIG. 2, once the diver 68 reaches the gas generator 54, the diver opens the cap 66 by turning the crank 64. The gas generator energy source 70 is then placed inside of combustion chamber 56 by the diver 68. Thereafter, as shown in FIG. 3, the diver 68 closes the cap 66 and secures it shut by the turning of crank 64. If the gas generator energy source 70 is of the type that requires an electric current for activation, the activation means 72 can be connected through electrical cable 74 which connects through plug 76 to the gas generator energy source 70 to allow current flow therethrough from the activation means 72. The current flow through the gas generator energy source 70 will cause high pressure gas to be generated inside of combustion chamber 56. The high pressure gas inside of combustion chamber 56 is transmitted via supply conduit 52 to the pistons 40 of the pipe squeezer assembly 28. A relatively incompressible liquid may be contained in the supply conduit 52 to insure the maximum delivery of pressure therethrough to the pistons 40.

While it is realized that the gas generator 54 is merely shown pictorially, a typical such gas generator is manufactured by Atlantic Research located in Alexandria, Va. If such a gas generator is used, the gas generator energy source 70 may be a propellant that is activated by current flow therethrough of a predetermined amperage. Therefore, the activation means 72 would have to be some type of electrical energy source, such as a battery, that would generate the minimum required current.

Figure 4:
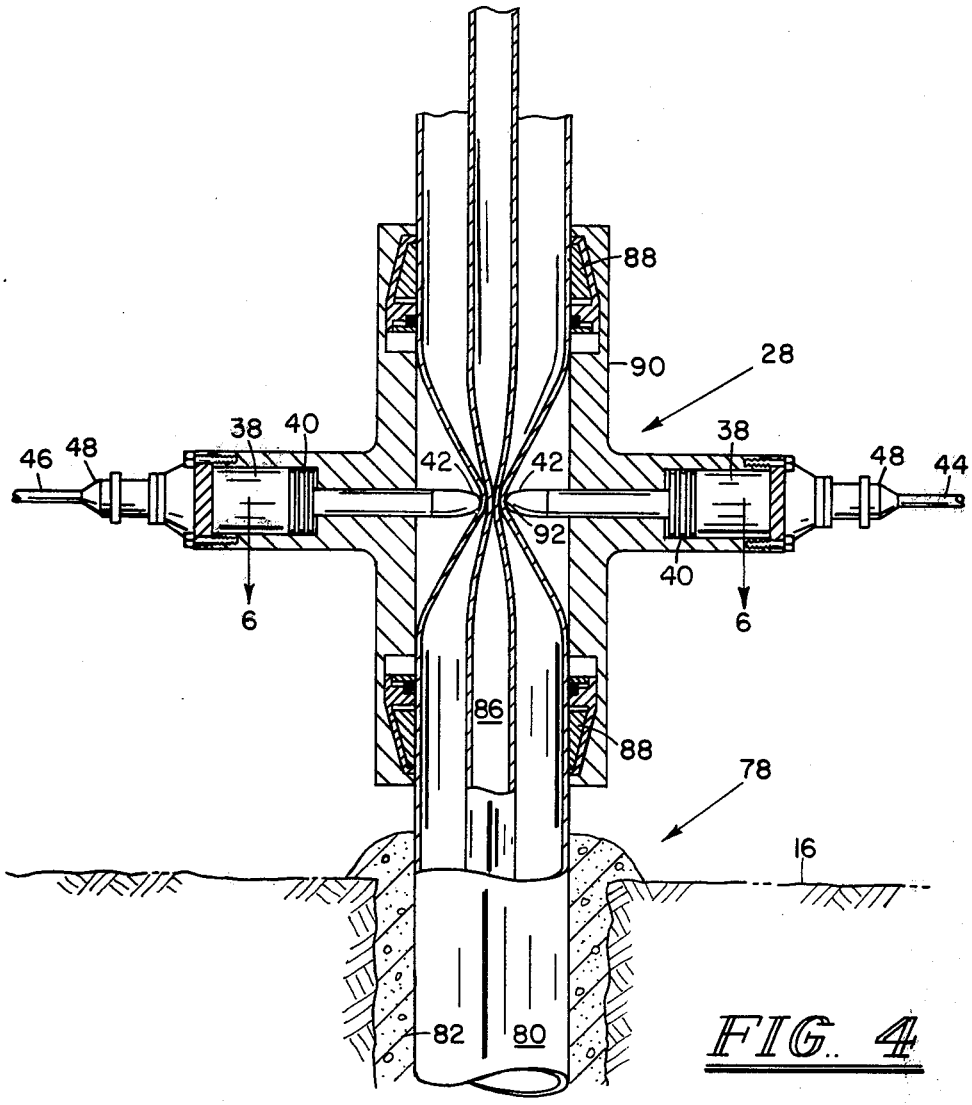
FIG. 4 is an illustrative partial cross-sectional view of rams operated by the gas generator to pinch tubing shut to stop flow therethrough.

Assume now that the pipe squeezer assembly 28 is being installed on an old well 78 on the ocean floor 16 as shown in FIG. 4. The outer casing 80 is retained in the ocean floor 16 and secured in position by cement 82. Inside of the outer casing 80 is concentric pipe or tubing 86.

The pipe squeezer assembly 28 is connected to the outer casing 80 immediately above the ocean floor 16 by gripping seals 88 on each end of container housing 90. The gripping seals 88 secure and seal the pipe squeezer 28 to the outer casing 80. Upon firing the gas generator 54 (previously described herein), high pressure fluid is delivered into cylinders 38. The high pressure in cylinders 38 drives pistons 40 toward the outer casing 80 along with rams 42. The closing of rams 42 pinch the outer casing 70 an concentric pipe 80 and 86 closed. In case of an external leak at the point of crimping 92, the gripping seals 88 keep the hydrocarbon from leaking into the ocean.

Figure 6A:
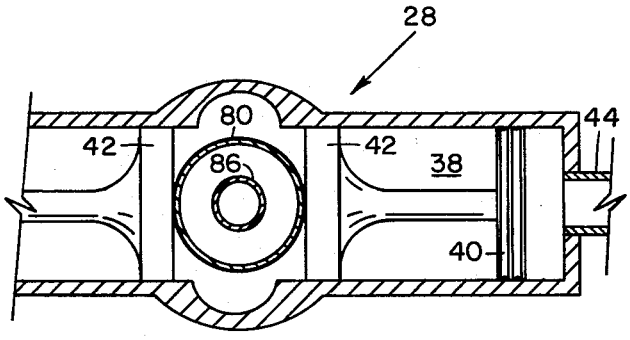
FIGS. 6*a* and 6*b* are sequential pictorial illustrations along sectional lines 6—6 of FIG. 4 showing a blind ram being used to pinch concentric pipes closed by the present method.
Figure 6B:
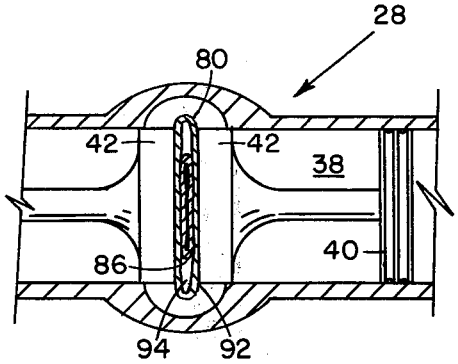

Referring to FIGS. 6*a* and 6*b*, one type of rams 42 with flat faces, commonly known as "blind rams," is shown being used. FIGS. 6*a* and 6*b* are pictorial sequential views taken along section lines 6—6 of FIG. 4. Prior to activation, the pipe squeezer assembly 28 appears generally as shown in FIG. 6*a*. However, after activation of the gas generator 54, the pipe squeezer assembly 28 and the outer casing 80 with the concentric pipe 86 appear as shown in FIG. 6*b*. Opening 94 at the point of crimping 92 in the outer casing 80 may still allow fluid to flow therethrough if production is flowing between the concentric pipe 86 and the outer casing 80. However, normally the concentric pipe 86 (the inner tubing) is the production tubing so that upon sealing concentric pipe 86, flow of hydrocarbons to the surface where the fire is raging has been terminated. By the application of enough pressure from the gas generator to the cylinder 38, the blind rams 42 can displace further and close opening 94; however, a much larger amount of pressure is required.

Figure 7A:
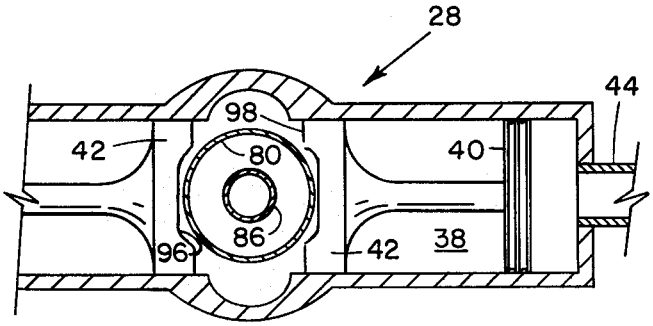
FIGS. 7*a* and 7*b* are sequential pictorial illustrations along section lines 6—6 of FIG. 4 showing a particularly shaped ram being used to pinch concentric pipes closed by the present method.
Figure 7B:
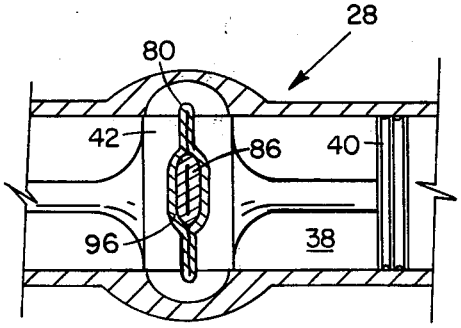

By the use of rams 42 as shown in fthe sequential views of FIGS. 7*a* and 7*b*, even the opening 94 previously shown in FIG. 6*b* can be closed. The rams 42 have an indented surface 96 in the face 98 thereof. The indented surface 96 is parallel to the outer casing 80 and the concentric pipe 86. By the proper design of the size of the indented surface 96 in light of the size of the concentric pipe 86 and by activation of the pipe squeezer assembly 28 as shown in FIG. 7, the concentric pipe 86 is crimped shut as well as the outer casing 80. The result of crimping outer casing 80 and the concentric pipe 86 by pipe squeezer assembly 28 with a particularly shaped ram with indented surface 96 is shown in FIG. 7*b*.

Figure 5:
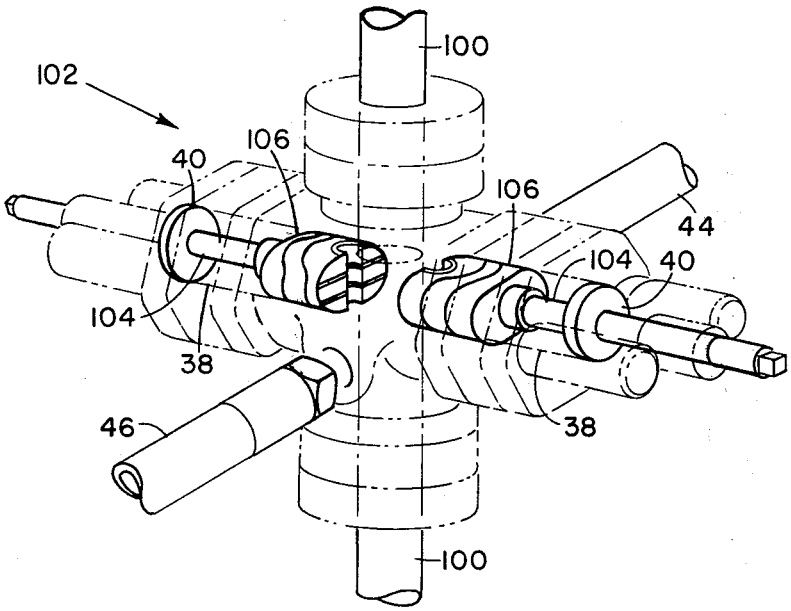
FIG. 5 is an illustrative partial pictorial view of blowout preventers remotely operated by the gas generator to close the well in case of fire.

Assume that the apparatus for carrying out the present invention is being installed upon a new well located on the ocean floor. Rather than installing the pipe squeezer assembly 28 as previously described, appropriate valving can be included in the string of production pipe at the wellhead to shut off flow to the offshore drilling platform 10 by means of the gas generator 54. Referring to FIG. 5, the production tubing 100 is connected through a type of valving 102. Valving 102 may be a typical blowout preventer as manufactured by Shaffer Tool Works in Beaumont, Tex. or it may be a remotely activated Christmas tree as manufactured by Cameron Iron Works in Houston, Tex. The valving 102 again connects to conduits 44 and 46 and internally connects to cylinders 38 and pistons 40 contained thereon. The pistons 40 upon receiving high pressure gas from the gas generator 54 via conduits 44 and 46 move toward the production tubing 100 carrying the shafts 104 therewith. On the opposite end of the shafts 104 are located the ram assemblies 106. The ram assemblies 106 block the flow of hydrocarbons through the annulus upon activation of the gas generator 54 to deliver high pressure gas to cylinders 38. By the use of the valving 102 as shown in FIG. 5 for a new well, upon putting out the fire on the offshore drilling platform 10 and repairing the damage at the surface, the well may be reconnected and the valving 102 opened.

While the present invention is shown in conjunction with only one well, the high pressure gas from the gas generator 54 may be communicated to numerous wells simultaneously by appropriate connections to the supply conduit 52 shown in FIG. 1. The only limitations are the amount of pressure and volume required to close each well, including necessary expansion to operate the pistons 40. Such limitations are determined primarily by the capacity of the gas generator. By appropriate design, all of the wells supplying one offshore drilling platform 10 can be closed simultaneously.

We claim:

1. During cases of emergency on offshore drilling platforms, a method of shutting off flow from at least one underwater well to the offshore drilling platform from a remote underwater location consisting of the following steps:

positioning a well closure device at a wellhead of said well;

connecting said well closure device to an energy generating device by energy transmitting means;

providing a remote underwater location from said well and said offshore drilling platform with energizing apparatus connected to said energy generating device;

sending a diver to said remote underwater location upon said case of emergency, said diver carrying activation means for said energy generating device to said energizing apparatus;

activating said energy generating device by said activation means and energizing apparatus from said remote underwater location by said diver to generate energy;

communicating said energy via said energy transmitting means to said well closure device; and closing of said well by said well closure device in response to said energy.

2. The method of closing at least one underwater well as given in claim 1 wherein said energy generating device is gas generator means, said activating step including igniting a gas producing substance in said gas generator means by said activation means to create high pressure gas forming said energy.

3. The method as given in claim 2 wherein said well closure device is a pinching device operated by said high pressure gas for forcing walls of said well together in said closing step.

4. The method as given in claim 2 wherein said well closure device is valving means operated by said high pressure gas for stopping flow from said well in said closing step.

5. The method of closing at least one underwater well as given in claim 2 wherein said communicating step includes said high pressure gas acting on said well closure device via said transmitting means.

6. The method as given in claim 5 wherein said sending step includes said diver carrying gas producing substance to said gas generator means, said gas generator means being located at said remote underwater location with said energizing apparatus.

7. The method of closing at least one underwater well as given in claim 5 including a further step of matching said pinching device to number of strings of pipe extending from said well, said matching step including selection of particularly designed ram for said pinching device to close each of said strings of pipe.

8. An apparatus for closing at least one well during an emergency from a remote location, said well having at least one pipe extending from said well, said apparatus comprising:

well closure means located at said well and attached to said pipe;

energy generating means including a gas generator;

first connecting means between said energy generating means and said well closure means for transmitting energy therebetween;

energizing apparatus located at said remote location;

second connecting means between said energizing apparatus and said energy generating means;

activation means removably connected to said energizing apparatus, said activation means being constructed and arranged to activate said energy generating means from said remote location to produce a high energy source, said first connecting means transmitting said high energy source to said well closure means to stop flow through said pipe.

9. The apparatus as given in claim 8 wherein said gas generator is positioned at said remote location with said energizing apparatus being an electrical connection to said gas generator, said activation means being a source of electric current removably connected to said electrical connection.

10. The apparatus as given in claim 9 wherein said activation means also includes a propellant removably inserted in said gas generator for generating a high pressure gas thereby giving said high energy source in response to a current flow through said electrical connection from said source of electric current.

* * * * *